US012377332B1

(12) United States Patent
Peterson

(10) Patent No.: US 12,377,332 B1
(45) Date of Patent: Aug. 5, 2025

(54) PORTABLE MODULAR TARGET FOR BAG TOSS GAME

(71) Applicant: Mark A. Peterson, Houston, TX (US)

(72) Inventor: Mark A. Peterson, Houston, TX (US)

( * ) Notice: Subject to any disclaimer, the term of this patent is extended or adjusted under 35 U.S.C. 154(b) by 723 days.

(21) Appl. No.: 17/586,572

(22) Filed: Jan. 27, 2022

Related U.S. Application Data

(60) Provisional application No. 63/143,634, filed on Jan. 29, 2021.

(51) Int. Cl.
*A63B 67/06* (2006.01)
*A63B 71/06* (2006.01)

(52) U.S. Cl.
CPC ..... *A63B 67/06* (2013.01); *A63B 71/0672* (2013.01); *A63B 2210/50* (2013.01)

(58) Field of Classification Search
CPC .. A63B 67/06; A63B 71/0672; A63B 2210/50
See application file for complete search history.

(56) References Cited

U.S. PATENT DOCUMENTS

| | | | | | |
|---|---|---|---|---|---|
| 3,001,791 | A * | 9/1961 | Atwood | A63B 67/04 | 273/342 |
| 3,628,793 | A * | 12/1971 | Mudloff | A63B 67/06 | 473/594 |
| 4,961,586 | A * | 10/1990 | Conville | A63F 9/02 | 273/402 |
| 5,056,796 | A * | 10/1991 | Conville | A63B 67/06 | 273/402 |
| 5,909,877 | A * | 6/1999 | Bour | A63F 9/0204 | 273/402 |
| 7,607,666 | B1 * | 10/2009 | Studier | A63B 63/00 | 116/222 |
| 10,675,529 | B1 * | 6/2020 | Lumia | A63F 9/0204 | |
| 2008/0116644 | A1 * | 5/2008 | Knoernschild | A63B 67/06 | 273/343 |
| 2013/0082442 | A1 * | 4/2013 | Hanel | A63B 67/06 | 273/398 |

* cited by examiner

*Primary Examiner* — Eugene L Kim
*Assistant Examiner* — Christopher Glenn
(74) *Attorney, Agent, or Firm* — Kenneth A Roddy

(57) ABSTRACT

A portable modular target for a bag toss game has two platform modules that can be releasably connected to form a full size target platform and can be disconnected and nested together to form a smaller compact parallelepiped carrying case similar to a briefcase that contains all of the game play components for easy transport and storage.

7 Claims, 4 Drawing Sheets

PORTABLE MODULAR TARGET FOR BAG TOSS GAME

CROSS REFERENCE TO RELATED APPLICATION

This application claims priority of U.S. Provisional Application Ser. No. 63/143,634 filed Jan. 29, 2021, the pendency of which is extended until Jan. 31, 2022 under 35 U.S.C 119(c)(3).

BACKGROUND OF THE INVENTION

1. Field of the Invention

This invention relates generally to target assemblies for bag toss games and, more particularly, to a portable modular target for a bag toss game having two platform modules that can be releasably connected to form a full size target platform and can be disconnected and nested together to form a smaller compact parallelepiped carrying case that holds all the game play components for easy transport and storage.

2. Background Art

The lawn game known as "cornhole", also known as "corn toss", "bean bag toss" or "tailgate toss", is increasing in popularity across the United States. The game consists of two elevated platforms, typically made of wood, located several feet apart in a level area. The platforms are inclined at an angle with the lower end located typically two to four inches above the ground and the higher end approximately twelve inches above the ground. A standard platform generally measures two feet wide by four feet long with a six inch circular aperture centered horizontally on the board approximately nine inches from the edge of the higher end. Each platform weighs roughly 25 to 30 lbs., and they are often carried one at a time from storage place or vehicle to game positions, with the bags and other components being carried separately. In a standard game, the platforms are placed facing each other approximately twenty-seven feet apart. Players take turns tossing a small bag filled with dried beans, corn or other pellets at the platform the farthest from them. Points are awarded for landing the bag on the platform or sending the bag through the target aperture, with a greater number of points awarded for sending the bag through the target aperture. The bag can go through the target aperture by either hitting the target aperture directly or sliding the bag across the board into the aperture.

One of the major problems with conventional platforms is that two foot by four foot wooden platforms used for professional players is heavy and rigid, and cannot be easily transported in a typical automobile. Others have attempted to overcome this problem by providing a platform having a length of three feet and/or making them of lighter weight materials. The lighter style platforms that are smaller than regulation size make them illegal for use at tournaments. There is also an inherent problem with lighter weight platforms because the bags tend to bounce on the target surface and, thus, produces additional difficulty and a different game playing experience. Game aficionados prefer the standard four foot long heavy and rigid platform which is used by professional players for a purer playing experience. There are also two-piece hinged folding platforms known in the art, but they tend to be lighter in weight and when erected to form an inclined target for play they are not very rigid and do not provide a solid target structure.

The following patents are several examples of bag toss platforms of various construction that can be reconfigured for storage and/or storage and portability.

Mudloff, U.S. Pat. No. 3,628,793, discloses an indoors or outdoors sandbag tossing and point-scoring game device characterized by a pair of like wedge-shaped half-sections which when assembled and latched, provide a carrying and transporting case. When unfastened and parted these sections can be used, individually or collectively, as sandbag-trapping targets. In use, each half-section provides an inclined surface and has a centralized sandbag-receiving hole.

Conville, U.S. Pat. No. 4,961,586, discloses a molded plastic bag tossing game for use by one or more players that can be disposed in either a transportable mode, a display mode, or a playing mode. In the playing mode a pair of identical, modular target assemblies are deployed in spaced apart relationship to present a pair of slightly inclined, apertured targets towards which soft bags are thrown to generate points in accordance with rules. Each target assembly comprises a resilient, molded plastic playing board of generally rectangular configuration, which includes an upper, elevated target aperture, a removable elevator tray which can be snap fitted to the boards to gently incline them for play. A brace extending from the board underside reinforces the trays during play. For storage each elevator tray can be flatly snapped into position on the underside of the target board captivating the bags, and securing the brace to prevent rattling noises. The boards may be frictionally fitted together in the transportable.

Conville, U.S. Pat. No. 5,056,796, discloses a blow molded, plastic, bag tossing game for use by one or more players which is a continuation-in-part of the U.S. Pat. No. 4,961,586 patent above, having two elevator trays that are pivotally coupled to each board, and can be folded into position on the underside of the target board for storage. The boards may be fitted together to maintain a sleek, overall low profile. Handles project from recessed notches defined in each playing board, and hook means are provided for flush mounting the game.

Bour, U.S. Pat. No. 5,909,877, discloses a bag tossing game target having first and second generally planar, equally sized panels that are connected together by a hinge. The first and second panels are moveable between a first, in-use configuration in which the first and second panels are coplanar, and a second, folded configuration in which the first and second panels lay back-to-back to each other. The first panel has a hole therein which is sized such that a bag can be tossed therethrough. The first and second panels each include an elongated hole adjacent one edge to form a handle by which the folded target can be carried. The panels are formed of a lattice structure to render the target lightweight. Further, the thickness of the lattice structure is reduced whereby a series of pockets are defined between the panels when folded. Elongated support legs are provided which can be detachably secured to one of the panels at one end and rest upon the ground at the other end to support one of the panels above the ground while an end of the other panel rests upon the ground. The legs are sized and shaped such that when detached from the panel, the legs can be nested within one of the pockets when the panels are folded. In this way, the legs are retained within the folded target, reducing the chances that the legs will be misplaced. The bags used during play of the game can also be nested within the pockets.

Studier, U.S. Pat. No. 7,607,666, discloses a corn toss game consisting of a foldable weatherproof game apparatus having a top portion with a hole in the center and longer a rear leg pivotally affixed to the top portion, a bottom portion hingedly affixed to the top portion, a net underneath the hole to catch tossed corn-filled bags, and a fastening means for locking the game apparatus into a folded, closed position for easy transport, as well as a separate scoreboard having a hanging means rotatably secured to which scorecards are slidably affixed and having at least one integral cup holder and a plurality of corn-filled bags. An alternate embodiment has a wedge-shaped game apparatus having a hole with a net.

Knoernschild, U.S. Published Application 2008/0116644, discloses a toss game which has two casings the sit one within the other. Each casing has a playing surface that has groups of toss targets. Correlated to each of the groups of toss targets are groups of scoring indicia. Each target surface is maintainable above a ground surface location. During play the casings are positioned an operating distance away from one another. The casings also have carrying handles and contain storage space for game components.

Hanel, U.S. Published Application 2013/0082442, discloses an improved lightweight, easy to use and carry version of the original bean bag toss game board that allows the user to fold up the game boards into a case and easily carry them around with the beanbags inside. The lightweight construction allows one game board to fit within the other while forming a case for game bags. A carrying handle for carrying also acts as a hinge-free locking fastener for easy assembly when game set is packed for carrying or storage. Folding legs allow the boards to fit together in a small space and have an offset pivot point that provides the strength of having three points of contact when in the open position.

SUMMARY OF THE INVENTION

The present invention overcomes the aforementioned problems and is distinguished over the prior art in general, and these patents in particular by a portable modular target for a bag toss game formed of a first and a second platform module that may be coupled together to form a full size elongated inclined platform in a playing mode or separated and nested together in a compact parallelepiped carrying case configuration that contains all the game play components for easy transport and storage. The first platform module has a rectangular top surface with a hole therethrough adjacent to a first end thereof for receiving bags tossed at the hole, a first rectangular frame on the underside of the rectangular top surface having a first end wall and two side walls inwardly adjacent to said one end and two outer edges of the top surface, respectively, extending downward from an underside thereof, and a second end wall extending downward from an edge opposite the first end of the first platform.

The second platform module has a rectangular top surface, a second rectangular frame on the underside thereof having four side walls extending downward from outer edges of the top surface of the second platform module configured to abut the second end wall of the first rectangular frame in the assembled playing mode configuration such that the combined top surfaces of the first and second platform modules form a contiguous playing surface for the bag toss game. Brace members are removably attached to the first and second rectangular frames to maintain the top surfaces of the first and second platform modules in alignment in the assembled playing mode configuration.

A leg assembly having one end pivotally connected to the first platform module and an opposite end configured to engage a support surface is selectively pivoted between a stored position within the first rectangular frame of the first platform module in the storage and transport mode, and a deployed position extending outwardly and downwardly therefrom to engage the support surface and support the top surfaces of the adjoined first and second platform modules on the support surface in the inclined playing mode configuration. The leg assembly may include scoring means for visually indicating the score for each player.

The first rectangular frame on the underside of the rectangular top surface of the first platform module is slidably received inside the second rectangular frame on the underside of the second platform module in the nested compact rectangular parallelepiped carrying case configuration in the storage and transport mode. The brace members, bags, and all of the game components are stored within the carrying case.

One of the significant features and advantages of the present invention is that the first and second platform modules may be coupled together to form a full size elongated inclined platform in a playing mode, and easily separated and nested together in a compact parallelepiped carrying case configuration, similar to a briefcase, that contains all the hardware and game play components for easy transport and storage.

Another feature and advantage of the invention is that the modular target in the nested compact rectangular parallelepiped carrying case configuration take up half the space of a typical regulation size bag toss target and can easily be transported in the back seat or trunk of a small automobile.

Another feature and advantage of the invention is that the modular target can be easily and quickly assembled and disassembled without requiring any special tools.

Another feature and advantage of the invention is that the leg assembly includes scoring means for visually indicating the score for each player.

Other features and advantages of the invention will become apparent from time to time throughout the specification and claims as hereinafter related.

DETALED DESCRIPTION OF THE INVENTION

Figure 1:
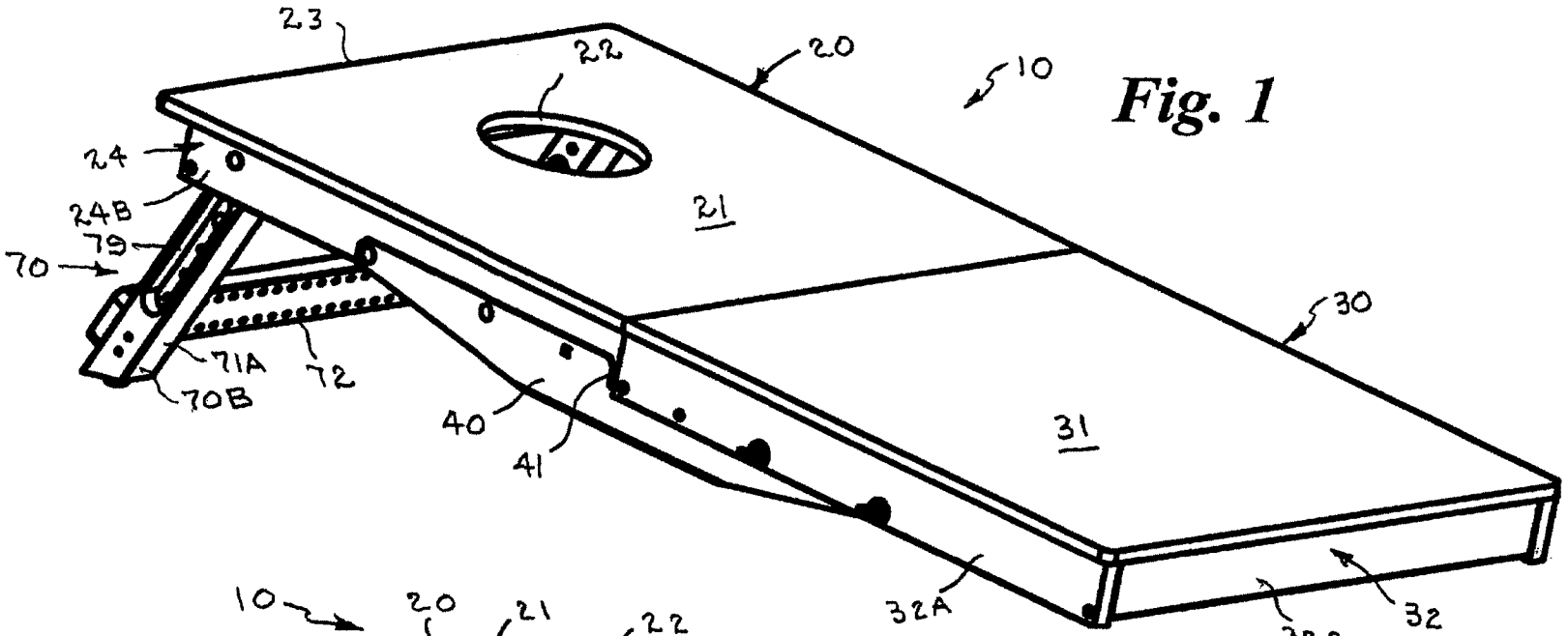
FIG. 1 is a perspective view of the portable modular target for a bag toss game in accordance with the present invention shown from the front, top, and one side in the assembled playing mode configuration.

Referring now to the drawings by numerals of reference, there is shown in FIGS. 1-6, a portable modular target 10 for a bag toss game in accordance with the present invention in an assembled playing mode configuration. The modular target 10 includes a first platform module 20 and a second platform module 30 releasably connected together. The first platform module 20 has a rectangular top surface 21 with a hole 22 therethrough adjacent to a first end 23 thereof for receiving bags tossed at the hole, a first rectangular frame 24 on the underside of the top surface having a first end wall 24A, two laterally opposed side walls 24B and 24C inwardly adjacent to the first end 23 and two outer edges of the top surface 21, respectively, which extend downward from an underside to the top surface, and a second end wall 24D that extends downward from an edge of the top surface opposite the first end 23. The second end wall 24D has a generally rectangular cutout portion 25 disposed adjacent to its juncture with the top surface 21.

The second platform module 30 has a rectangular top surface 31, and a second rectangular frame 32 on the underside thereof which has two laterally opposed side walls 32A, 32B, and two end walls 32C and 32D that extend downward from the four outer edges of the top surface 31. The end wall 32D of the second platform module 30 is configured to abut the second end wall 24D of the first rectangular frame 24 in the assembled playing mode configuration such that the combined top surfaces 21 and 31 of the first and second platform modules form a complete contiguous playing surface for the bag toss game. The second end wall 32D has a generally rectangular cutout portion 33 disposed adjacent to its juncture with the top surface 31.

Figure 3:
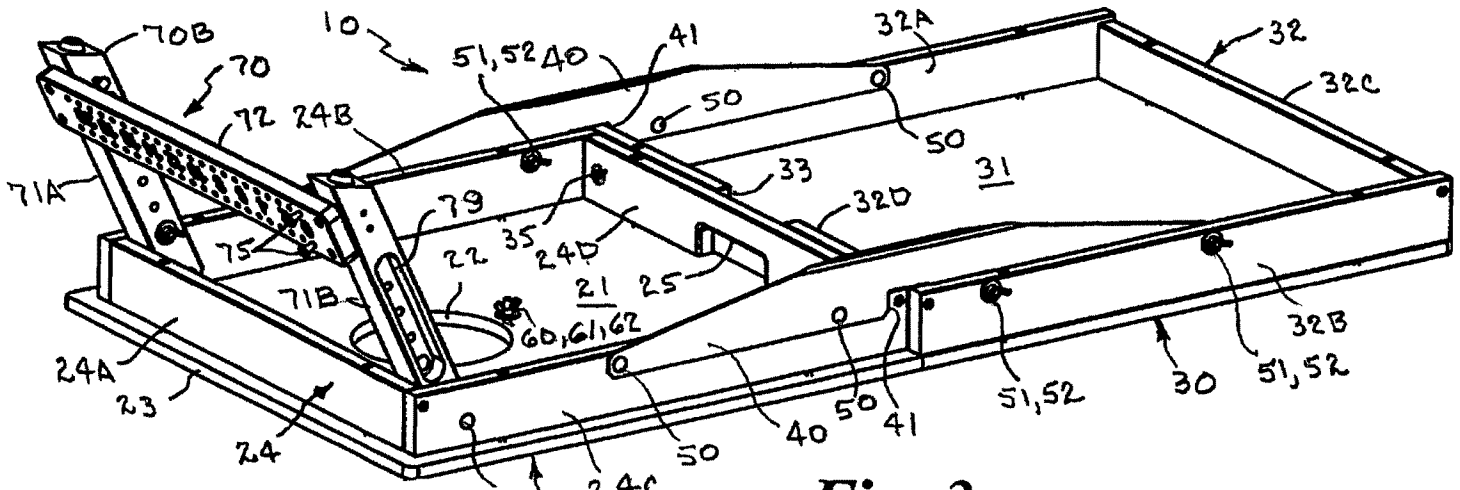
FIG. 3 is a perspective view of the portable modular target in an inverted position shown from the front, bottom, and one side in the assembled playing mode configuration.
Figure 4:
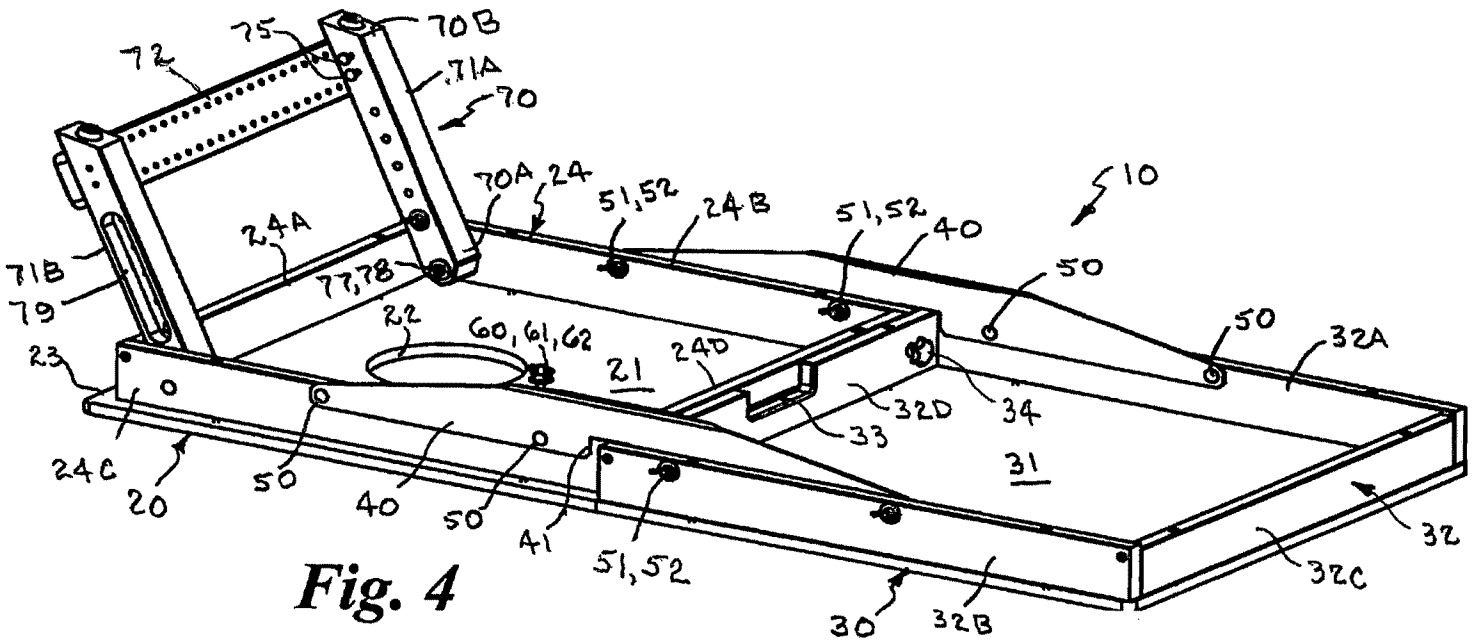
FIG. 4 is a perspective view of the portable modular target in an inverted position shown from the rear and the side opposite that shown in FIG. 3.

As seen from the underside in FIGS. 3 and 4, the first platform module 20 and second platform module 30 are releasably connected together by a pair of threaded-stud knobs 34 having their threaded stud portion extending through laterally spaced apertures in the abutted second end wall 24D of the first rectangular frame 20 and the end wall 32D of the rectangular frame 32 of the second platform module 30 and threadedly engaged in a tee nut 35 on the inner facing side of the end wall 24D. As described hereinafter, these same threaded-stud knobs 34 and tee nuts 35 are used for securing the two platform modules together in a nested compact parallelepiped carrying case configuration. It should be understood that other types of fasteners may be used, however, the threaded-stud knob and tee nut arrangement is preferred because no tools are required for assembly or disassembly.

The first rectangular frame 24 on the underside of the rectangular top surface of the first platform module 20 is sized to be to be slidably received inside the second rectangular frame 32 on the underside of the second platform module 30 in a nested compact rectangular parallelepiped carrying case configuration a storage and transport mode, described hereinafter.

A pair of elongated brace members 40 are each removably attached to the outer facing side of the laterally opposed side walls 24B and 24C of the first rectangular frame 24 of the first platform module 20, and the inner facing side of the side walls 32A and 32B of the second rectangular frame 32 of the second platform module 30. The brace members 40 have a cutout portion 41 that straddles the abutted second end wall 24D of the first rectangular frame 24 and the end wall 32D of the rectangular frame 32 of the second platform module 30. The brace members 40 have longitudinally spaced apart holes therethrough aligned with holes through the side walls 24B and 24C of the first rectangular frame 24 of the first platform module 20, and the inner facing side of the side walls 32A and 32B of the second rectangular frame 32, and are attached to the side walls 24B and 24C and by carriage bolts 50, wing nuts 51 and washers 52.

The underside of the rectangular top surface 21 of the first platform module 20 is provided with a threaded stud 60, a washer 61, and a wing nut 62 for securing the brace members 40 to the underside of the top surface in a stored position in the storage and transport mode, described hereinafter.

Figure 2:
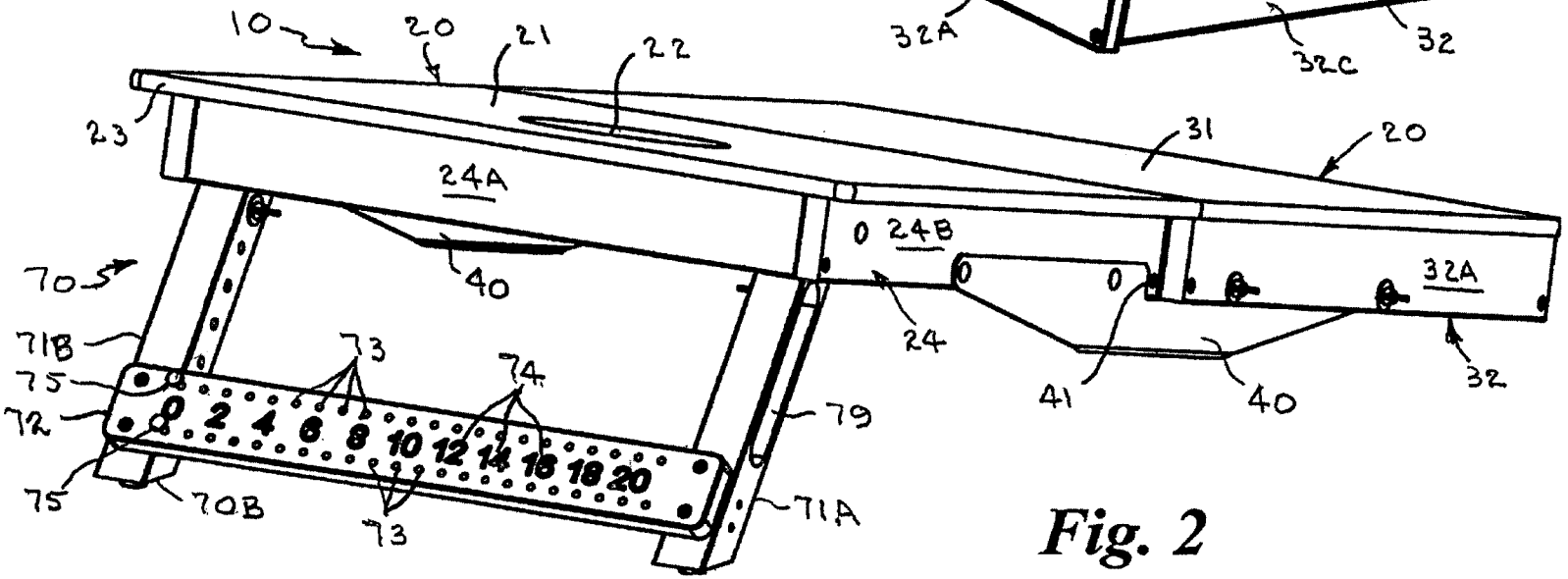
FIG. 2 is a perspective view of the portable modular target shown from the rear and the side opposite that shown in FIG. 1.

A leg assembly 70 is pivotally connected at one end 70A to the first platform module 20 and has an opposite end 70B configured to engage a support surface. The leg assembly 70 includes a pair of laterally opposed leg members 71A and 71B with a rectangular cross member 72 secured transversely therebetween. As best seen in FIG. 2, the cross member 72 has two horizontal rows of a series of small laterally spaced holes 73 extending therethrough. For example, forty-two small holes arranged in two rows of twenty-one holes each near the top and bottom of the cross member 72 representing two players. Scoring numerals 74 may be disposed on the cross member 72 between the rows of small holes to designate the scoring value of each hole. Two small pegs 75, such as for example golf tees, of different color representing the two players may be placed in the hole adjacent to the corresponding numeral to keep track of the score for each player, and moved after the end of each player's turn tossing bags to track the current score.

Figure 5:
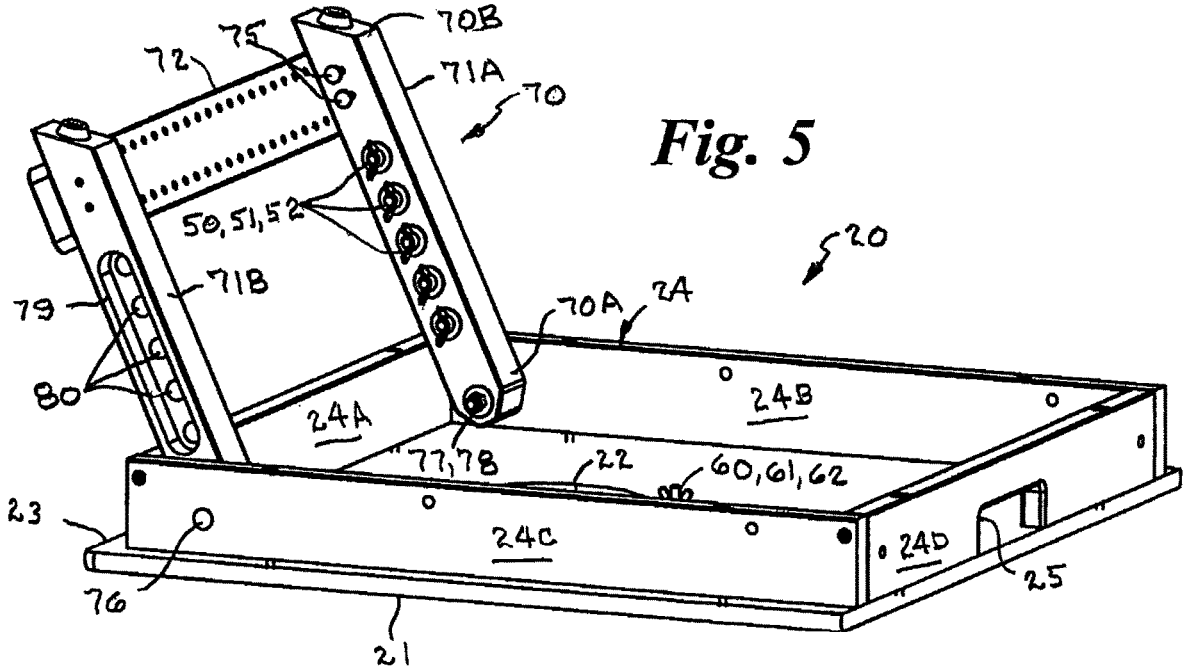
FIG. 5 is a perspective view of the first platform module in an inverted position shown from the front, bottom, and one side, more clearly showing the details of construction.
Figure 6:
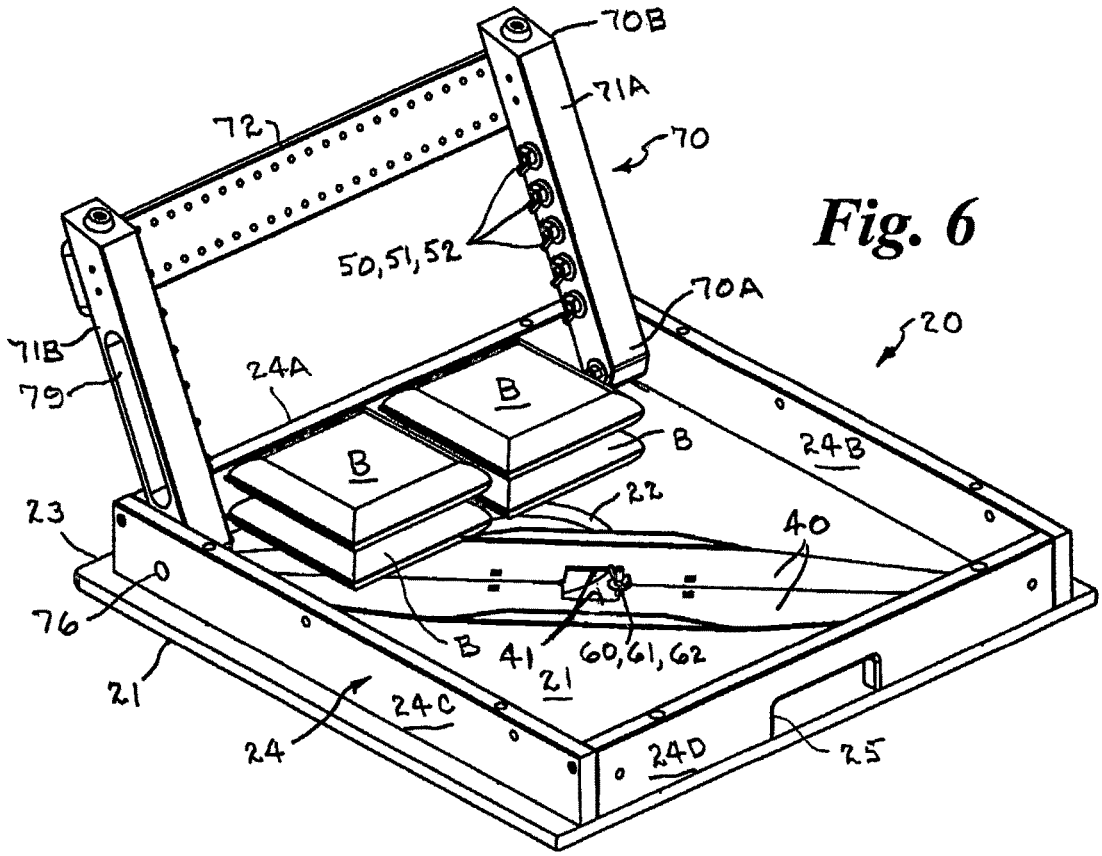
FIG. 6 is a perspective view of the first platform module in an inverted position shown with the braces secured to the underside with the bags and game components in the stored condition.

As shown from the underside in FIGS. 3, 5 and 6, the leg members 71A and 71B of the leg assembly 70 are pivotally connected to the inner facing side of the laterally opposed side walls 24B and 24C of the first rectangular frame 24 by a threaded stud 76, a washer 77, and a wing nut 78 and is selectively pivoted between a stored position within the first rectangular frame 24 on the underside of the top surface 21 and a deployed position extending outwardly and downwardly therefrom to engage a support surface and support the top surfaces of the adjoined first platform module and second platform module on the support surface in an inclined playing mode configuration.

The outer facing sides of the leg members 71A and 71B have an elongated recess 79 and a plurality of small longitudinally spaced holes 80 therethrough for storing the carriage bolts 50, wing nuts 51, washers 52, and pegs 75 in the storage and transport mode, described hereinafter. Two sets of extra hardware may be supplied and stored for use in case others become lost.

As shown in FIG. 6, when preparing the first platform module 20 for the storage and transport mode, the braces 40 are placed flat down, side-by side, to reside diagonally on the underside of the top platform 21 with their cutout portions 41 in contact with the threaded stud 60, a washer 61 is placed on the threaded stud and fastened down with the wing nut 62. The bean bags B, which are used for came play are also placed inside the inverted first platform module 20.

Figure 7:
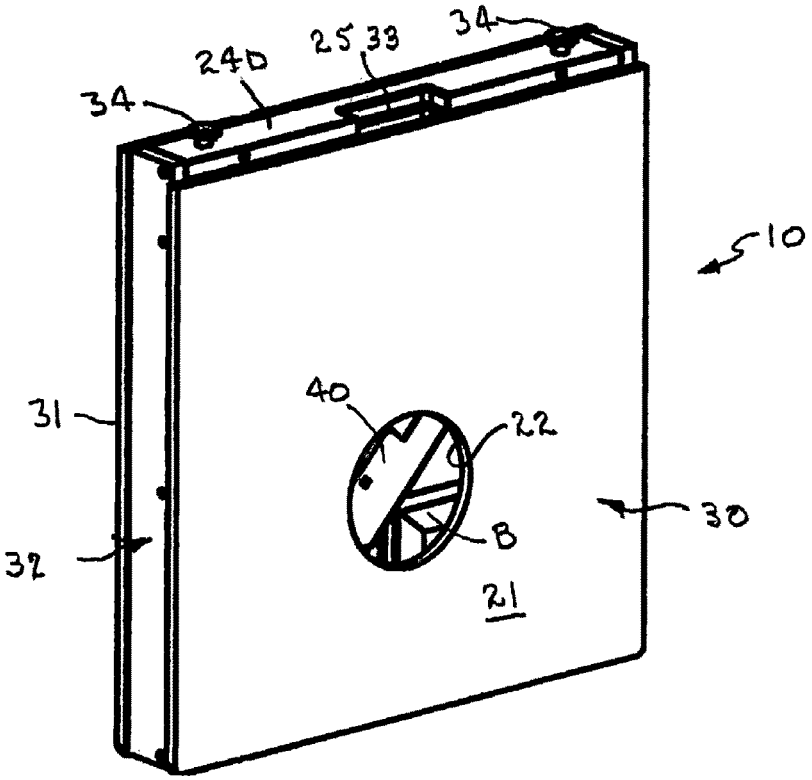
FIG. 7 is a perspective view of the first and second platform modules in a nested compact parallelepiped carrying case configuration as seen from the top, end, and one side.
Figure 8:
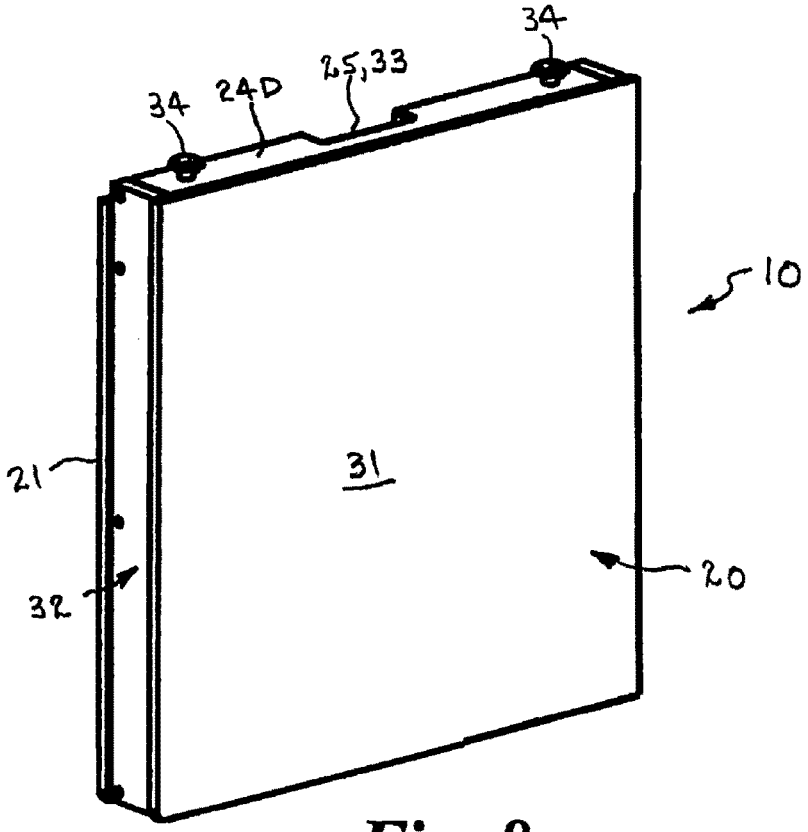
FIG. 8 is a perspective view of the first and second platform modules in the nested compact parallelepiped carrying case configuration as seen from the top, end, and the side opposite that shown in FIG. 7.

FIGS. 7 and 8 show the first and second platform modules nested together in the storage and transport mode. The threaded-stud knobs 34 holding the end wall 24D of the first rectangular frame 20 and the end wall 33D holding the first and second platform modules together are removed and, as discussed above, the first rectangular frame on the underside of the rectangular top surface 21 of the first platform module 20 is slidably received and nested inside the second rectangular frame 32 on the underside of the second platform module 30 in a compact rectangular parallelepiped carrying case configuration for compact storage and transport. When the platform modules are nested together, the threaded-stud knobs 34 are then placed back into the tee nuts and tightened to secure the platforms modules together with the knobs disposed on the outer side of the end wall 24D. When nested together, the in transportation configuration, the cutout portions 25 and 33 in the end walls of the platform modules allow for the hands and fingers to grasp the nested assembly for easy carrying, similar to a briefcase.

In a preferred embodiment, but not limited thereto, the top surfaces 21 and 31 of the first and second platform modules 20 and 30 when secured together in the playing mode form a complete contiguous playing surface which is two feet wide and four feet long, and in the nested storage and transport mode they form a parallelepiped carrying case which is two feet wide, two feet long, and three inches thick.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A portable modular target for a bag toss game, comprising:

a first and a second platform module adapted to be coupled to one another for orientation in either of an elongated inclined playing mode configuration or to be separated and coupled to one another in a nested compact parallelepiped carrying case configuration in a storage and transport mode;

said first platform module having a rectangular top surface with a hole therethrough adjacent to a first end thereof for receiving bags tossed at the hole, a first rectangular frame on the underside of the rectangular top surface having a first end wall, two side walls inwardly adjacent to said first end and two outer edges of the top surface, respectively, extending downward from an underside thereof, and a second end wall extending downward from an edge opposite said first end of the top surface;

said second platform module having a rectangular top surface, a second rectangular frame on the underside thereof having two side walls and two end walls extending downward from outer edges of the top surface of the second platform module configured to abut said second end wall of the first rectangular frame in an assembled playing mode configuration such that the abutted top surfaces of the first and second platform modules form a contiguous playing surface for the bag toss game;

brace members removably attached to said first and said second rectangular frames to maintain the top surfaces of the first and second platform modules in alignment in the assembled playing mode configuration;

a leg assembly having one end pivotally connected to said first platform module, and an opposite end configured to engage a support surface, said leg assembly selectively pivoted between a stored position within the first rectangular frame of said first platform module in the storage and transport mode, and a deployed position extending outwardly and downwardly therefrom to engage on the support surface in the inclined playing mode configuration;

the first rectangular frame on the underside of the rectangular top surface of said first platform module sized to be slidably received inside the second rectangular frame on the underside of said second platform module in the nested compact rectangular parallelepiped carrying case configuration in the storage and transport mode;

first fastener means for releasably connecting said first and second platform to one another to create the continuous playing surface in the elongated inclined playing mode and in the nested storage and transport mode; and second fastener means for removably attaching said brace members to said first and second rectangular frames in the elongated playing mode.

2. The portable modular target for a bag toss game according to claim 1, wherein:

said first fastener means for releasably connecting said first and second platform to one another comprise a pair of threaded-stud knobs having a threaded stud portion extending through laterally spaced apertures in the abutted second end wall of the first rectangular frame and the end wall of the rectangular frame of the second platform module and threadedly engaged in a tee nut on an inner facing side of the end wall in the elongated playing mode; and said threaded-stud knobs also used to secure said first and second platform together in the nested compact parallelepiped carrying case configuration.

3. The portable modular target for a bag toss game according to claim 1, wherein:

said second fastener means for removably attaching said brace members to said first and second rectangular frames in the elongated playing mode comprise carriage bolts having a threaded shank extending through longitudinally spaced apart holes in said brace members and in said side walls of said first and second rectangular frames, a washer received on the shank, and secured by a wing nut.

4. The portable modular target for a bag toss game according to claim 1, further comprising:

third fastener means on an underside of the top surface of said first platform module for removably attaching said brace members to the underside of the top surface in the storage and transport mode.

5. The portable modular target for a bag toss game according to claim 1, wherein:

said third fastener means comprises a threaded stud having one end secured on the underside of the top surface of said base and a threaded portion extending through cutout portions of said brace members, a washer received on an opposed end of the threaded portion and the brace members, and secured by a wing nut.

6. The portable modular target for a bag toss game according to claim 1, wherein:

said leg assembly has a pair of laterally opposed leg members each having one end pivotally connected to an inner facing side of a respective side wall of said first rectangular frame and a rectangular cross member secured transversely therebetween; and scoring means on said rectangular cross member for visually indicating a score for each player.

7. The portable modular target for a bag toss game according to claim 6, wherein said scoring means comprises two horizontal rows of a series of small laterally spaced holes extending through said cross member representing two players, respectively;

scoring numerals between said rows of small holes to designate a scoring value of each hole; and two small peg members of different color representing the two players configured to be received in a hole adjacent to the scoring numeral to keep track of the score for each player, and moved after each player's turn tossing bags to track the score.

* * * * *